US006553989B1

(12) United States Patent
Richardson et al.

(10) Patent No.: US 6,553,989 B1
(45) Date of Patent: Apr. 29, 2003

(54) SELF-CONTAINED BREATHING APPARATUS WITH EMERGENCY FILTRATION DEVICE

(76) Inventors: James M. Richardson, P.O. Box 7095, Live Oak Station, Myrtle Beach, SC (US) 29572; Matt R. Davis, P.O. Box 7095, Live Oak Station, Myrtle Beach, SC (US) 29572

( * ) Notice: Subject to any disclaimer, the term of this patent is extended or adjusted under 35 U.S.C. 154(b) by 0 days.

(21) Appl. No.: 09/910,556

(22) Filed: Jul. 20, 2001

(51) Int. Cl.[7] ..... A62B 7/10

(52) U.S. Cl. ..... 128/201.25; 128/202.27; 128/206.17; 128/206.15

(58) Field of Search ..... 128/201.25, 202.22, 128/202.24, 205.27, 206.15, 206.17, 202.27; 55/DIG. 33, DIG. 35

(56) References Cited

U.S. PATENT DOCUMENTS

| | | | | | |
|---|---|---|---|---|---|
| 1,789,262 | A | * | 1/1931 | Monro et al. | 55/DIG. 33 |
| 1,963,874 | A | * | 6/1934 | Stampe | 55/DIG. 33 |
| 2,642,061 | A | * | 6/1953 | Boyer | 55/DIG. 35 |
| 4,154,235 | A | * | 5/1979 | Warncke | 128/201.25 |
| 4,297,117 | A | * | 10/1981 | Holter et al. | 128/205.27 |
| 4,382,440 | A | * | 5/1983 | Kapp et al. | 128/201.25 |
| 4,453,544 | A | * | 6/1984 | Silverthorn | 55/DIG. 35 |
| 4,559,939 | A | * | 12/1985 | Levine et al. | 128/201.25 |
| 4,572,178 | A | * | 2/1986 | Takase et al. | 128/201.25 |
| 4,688,567 | A | * | 8/1987 | Kikuchi et al. | 128/206.15 |
| 4,754,751 | A | * | 7/1988 | Mausteller et al. | 128/201.25 |
| 4,787,925 | A | * | 11/1988 | Ansite | 55/DIG. 35 |
| 5,148,803 | A | | 9/1992 | Schlobohm | |
| 5,186,165 | A | | 2/1993 | Swann | |
| 5,303,701 | A | * | 4/1994 | Heins et al. | 128/206.17 |
| 5,315,987 | A | | 5/1994 | Swann | |
| 5,322,060 | A | * | 6/1994 | Johnson | 128/201.25 |
| 5,394,867 | A | | 3/1995 | Swann | |
| 5,400,780 | A | * | 3/1995 | Nishino | 128/205.27 |
| 5,524,616 | A | | 6/1996 | Smith et al. | |
| 5,531,803 | A | * | 7/1996 | Salapow et al. | 55/DIG. 33 |
| 5,562,092 | A | | 10/1996 | George | |
| 5,628,308 | A | * | 5/1997 | Harges, Jr. et al. | 128/201.25 |
| 5,640,952 | A | | 6/1997 | Swann et al. | |
| 5,964,218 | A | | 10/1999 | Smith et al. | |
| 5,996,580 | A | | 12/1999 | Swann | |
| 6,041,778 | A | | 3/2000 | Swann et al. | |
| 6,146,449 | A | * | 11/2000 | Lee et al. | 55/DIG. 33 |
| 6,363,934 | B2 | * | 4/2002 | Metzger | 55/DIG. 33 |

FOREIGN PATENT DOCUMENTS

| | | | | |
|---|---|---|---|---|
| DE | 674562 | * | 4/1939 | 55/DIG. 33 |

OTHER PUBLICATIONS

Racal Airstream, Inc., "The Racal Dual–Air System"; Sep. 1987.*

* cited by examiner

*Primary Examiner*—Aaron J. Lewis
(74) *Attorney, Agent, or Firm*—MacCord Mason PLLC

(57) ABSTRACT

A self-contained breathing apparatus (SCBA) that includes an emergency filtration device for use in the event of an SCBA malfunction or exhaustion is described. The SCBA may include an air supply, a visored face mask, a hose connecting the air supply to the face mask, and a regulator controlling the supply of air from the air supply to the face mask. The regulator has a regulator cover or front plate with a given configuration. The emergency air filtration device is adapted to connect to the face mask in place of the regulator, and includes an air filtration media within a housing, and a filtration device cover positioned in front of the device. The filtration device cover has a configuration corresponding to the given configuration of the regulator cover, so that the user responds by "muscle memory" to quickly replace the regulator with the filtration device under stressful conditions with limited visability.

20 Claims, 3 Drawing Sheets

SELF-CONTAINED BREATHING APPARATUS WITH EMERGENCY FILTRATION DEVICE

BACKGROUND OF THE INVENTION (1) Field of the Invention

The present invention relates generally to an emergency air filtration device, and in particular to an air filtration device for use with a self-contained breathing apparatus (SCBA) of the type worn by fire fighters in the event that the SCBA malfunctions or becomes exhausted.

(2) Description of the Prior Art

Fire fighters and other emergency personnel entering burning buildings or toxic areas must carry an SCBA that includes a face mask, an air supply, a hose for connecting the mask to the air supply, and a regulator to control the flow of air from the air supply to the mask. The face mask in usually comprised of a clear visor that extends at least partially over the facial area of the user, with straps or other means to hold the visor onto user's face. The mask includes a port, often in the visor, for connection of the mask interior to the air supply.

The regulator may be designed for connection directly to the mask. In this configuration, the regulator will include a connection fitting for use in connecting the regulator to the mask port, and a hose fitting for connecting the regulator to the hose. The front of the regulator is of a given configuration, which may vary by manufacturer and style. When the regulator is to be attached to the face mask, the regulator configuration is such that the regulator can easily be grasped by the user, who can determine the orientation of the regulator by feel. For example, the regulator may be generally circular and sized to fit within the user' hand, even when gloves are worn. The regulator may include a thumb stop or other orientation locator, which may be either a projection or depression, to aid the user in determining regulator orientation.

There is always the danger that the SCBA may malfunction or the air supply may become exhausted during use. If so, the user has only a few seconds to reach safety or find a new source of filtered air. Since timely escape from a burning building or other toxic area may not be possible, the prior art has proposed the use of emergency filtration devices that can be carried by the user to replace the non-functional SCBA.

Generally, these prior art devices are comprised of a housing enclosing a filtration media, with the housing being adapted to replace the regulator or other part of the SCBA to connect the emergency filtration device to the face mask. For example, the emergency filtration device can include a fitting that is inserted into the mask port that normally receives the regulator. The filtration device is carried by the user, e.g., on the user's belt, jacket, or other apparel. When the SCBA malfunctions, the user detaches the regulator, and then replaces the regulator with the filtration device.

Replacement of the regulator with the filtration device must be made under highly stressful conditions in which the user cannot breath and recognizes that he or she has only seconds before asphyxiation. Moreover, the user may be within a dark or smoky location that prevents the user from being able to visually observe the filtration device or the mask. Observation may also be prevented by the physical position of the mask relative to the user's line of sight. Therefore, a filtration device that promotes ease of connection under these circumstance would be of great value, possibly preventing deaths due to the inability of the user to timely attach the filtration device.

SUMMARY OF THE INVENTION

The present invention is directed to an emergency air filtration device for use with a self-contained breathing apparatus. The invention relates especially to a filtration device that can readily replace the regulator in an SCBA in the event that the SCBA malfunctions, becomes empty, or is otherwise no longer functional.

Generally, the emergency air filtration device is comprised of a housing having an inner end and an outer end; a filter media within the housing; an attachment fitting at the inner end of the housing; and a front cover over the outer end of the housing. The front cover, which may also serve as a flame or fire shield to protect the filter media from open flame, has a configuration corresponding to the configuration of the cover or front plate of the regulator of the SCBA air pack with which the filtration device is adapted to be used.

That is, the front cover is of approximately the same size and shape as the front of the SCBA regulator, and includes projections or depressions that correspond to projections or depressions on the regulator cover. For example, both the front cover of the filtration device and the cover of the regulator may be generally circular with a thumb stop or other projection. By conforming the shape of the filtration device cover to the shape of the regulator cover, it has been found that the ability of the user to quickly replace the regulator with the filtration device is greatly enhanced, even when the user is unable to see the filtration device or the attachment port.

Generally, this enhanced ease of attachment is believed to be due to the ability of the user to utilize "muscle memory". In "muscle memory," or "motor memory," certain movements are transformed as a result of repeated practice from a conscious action to an automatic action requiring no thought. In other words, a movement or series of movements practiced over a long enough period becomes automatic. This phenomenon is often used in athletic training and in military training, where an individual must learn to react quickly and automatically to a given set of circumstances without conscious thought.

Fire fighters and other SCBA users, through practice, becomes accustomed to the feel and manipulation of the regulator of the particular design of SCBA they are using, even under stressful and adverse conditions, and learn to manipulate the regulator without conscious thought. This trained ability to automatically manipulate the regulator by "muscle memory" is utilized in the present invention by positioning a cover on the front of the filtration device that has a configuration similar to the cover of the regulator. Thus, the user, who is already trained to manipulate the regulator, responds in the same manner to the filtration device, facilitating quick attachment of the device to the mask.

Various adapters can be positioned at the back of the device housing so that the filter can be used with different commercially available SCBA face masks. For example, a bayonet-type fitting can be used with filters designed for use with a Scott Air Pack.

Adapters for other port configurations are also possible, so long as the shape of the adapter corresponds to the shape of the port to permit an air-tight attachment. It will also be understood that the regulator can be attached at other positions in the SCBA. For example, the regulator can be positioned within the air hose between the air supply and the mask, or attached to the air supply.

The housing may be formed of two sections, while the adapter is formed of an annular fitting held in place when the two housing sections are brought together to form the filtration device housing. For example, the annular fitting may be held within an annular groove at the inner end of the housing. The housing may also include one or more one-way air exhaust valves so that expired air can be exhausted without going though the filtration media. Alternatively, these exhaust valves can be in the visor section or another part of the face mask.

Various types of filter media can be used in the filtration device, While the filter media may be comprised of a single material, a multi-layer media is preferably used, with each layer being adapted to remove a particular type of contaminant. For example, a three-layer filter media may include a particulate filter layer to remove particulates; an activated carbon layer to absorb harmful gases; and a carbon monoxide catalyst layer to convert carbon monoxide to carbon dioxide. The activated carbon layer is preferably formed of a solid bed of carbon for extended usage. A four-layer filter may also include a desiccant filter layer to remove moisture and thereby increase the effectiveness of the activated carbon and/or carbon monoxide catalyst layers.

The filter media may be packed within the filtration device housing, or the layers of filter material may be enclosed within a filter media housing to form a multi-stage filter cartridge, with the filter media housing being insertable within the outer filtration device housing. Contaminated air or smoke passes through particulate and desiccant filter layers, and then through the rear section that includes the activated carbon filter layers, and optionally the carbon monoxide catalyst filter layer.

In the event that a user of an SCBA realizes that the SCBA has malfunctioned or is empty, the user responding by trained reflexes, or "muscle memory", quickly detaches the SCBA regulator from an attachment port, grasps the similarly-shaped emergency filtration device, and attaches the filtration device at the position where the regulator was previously attached. Since the section of the regulator grasped by the user has essentially the same shape as the shape of the filtration device cover, the trained response of the user enables the user to quickly attach the filtration device without needing to see where the device is being attached, and without fumbling to find the proper way to connect the device, losing precious seconds that could mean the difference between life and death.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
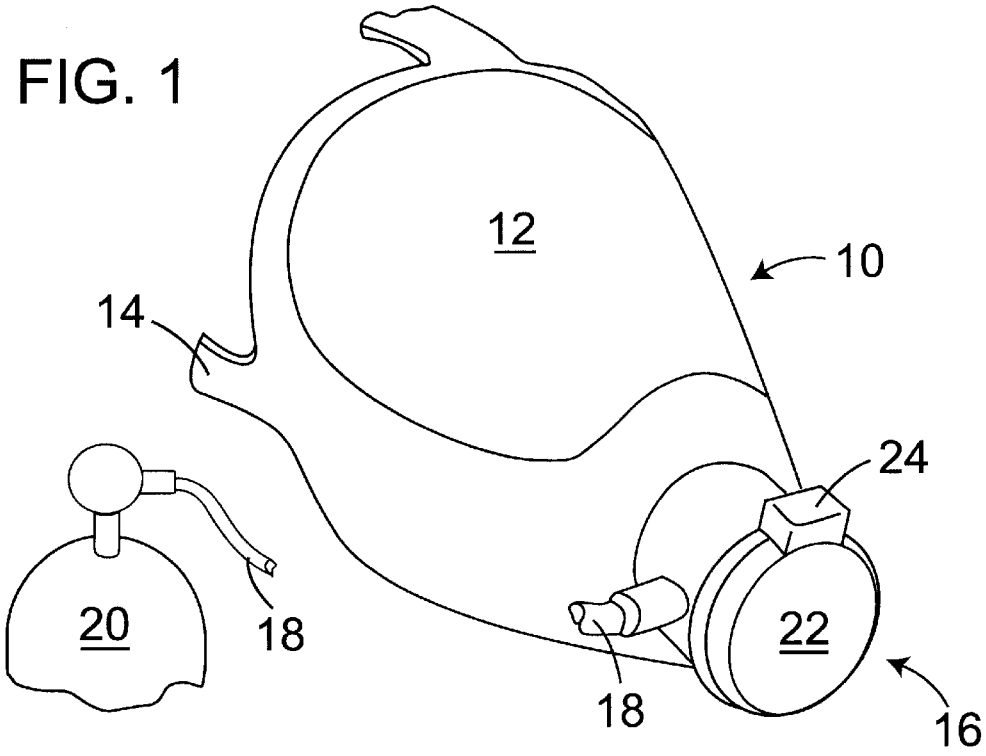
FIG. 1 is a perspective view of a self-contained breathing apparatus.
Figure 3:
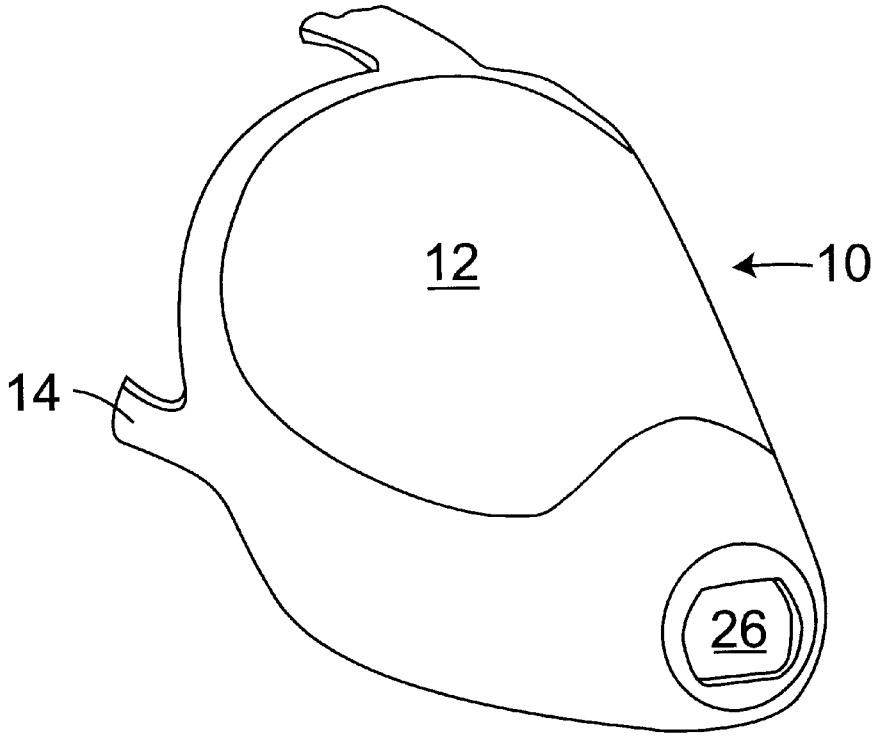
FIG. 3 is a perspective view of a mask showing the port for attachment of a regulator or the emergency filtration device.

As best shown in FIG. 1, a self-contained breathing apparatus is comprised of a mask, generally 10, that includes a clear visor 12 and straps 14 to secure mask 10 in front of the user's face. Regulator, generally 16, is positioned at the front of mask 10 and is connected via a hose 18 to an air supply, such as compressed air tank 20. Regulator 16 includes a front plate 22 of a given configuration with a thumb stop 24 to aid the user in positioning of regulator 16. As illustrated in FIG. 3, mask 10 includes port 26 to receive regulator 16. As illustrated, port 26 is adapted to receive a bayonet fitting.

Figure 2:
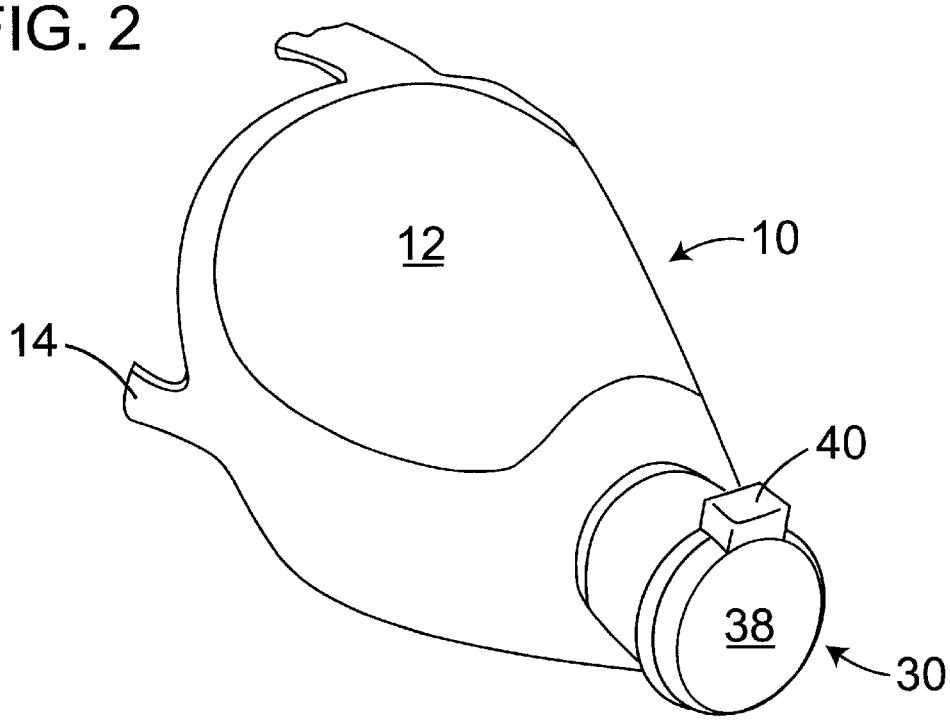
FIG. 2 is a perspective view of a mask with attached emergency filtration device.
Figure 4:
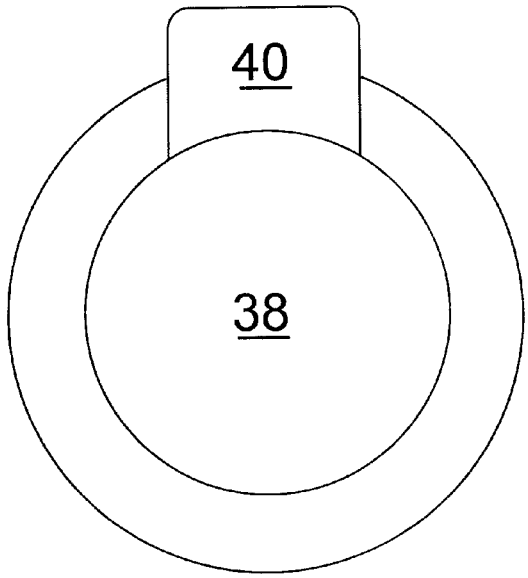
FIG. 4 is a front view of the emergency filtration device.
Figure 5:
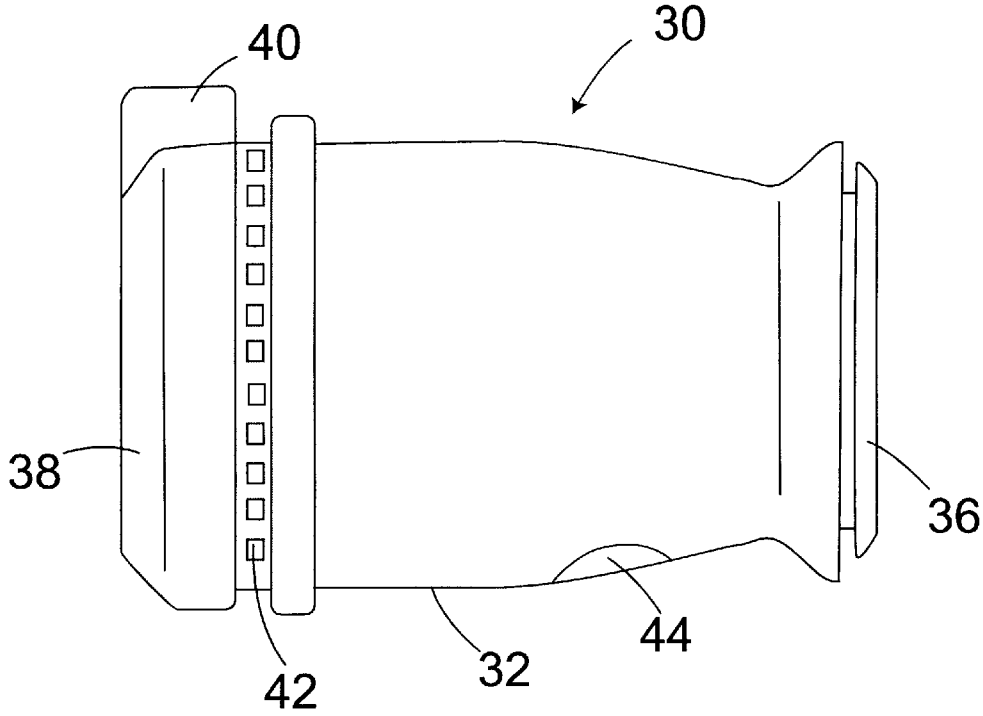
FIG. 5 is a side view of the emergency filtration device.
Figure 6:
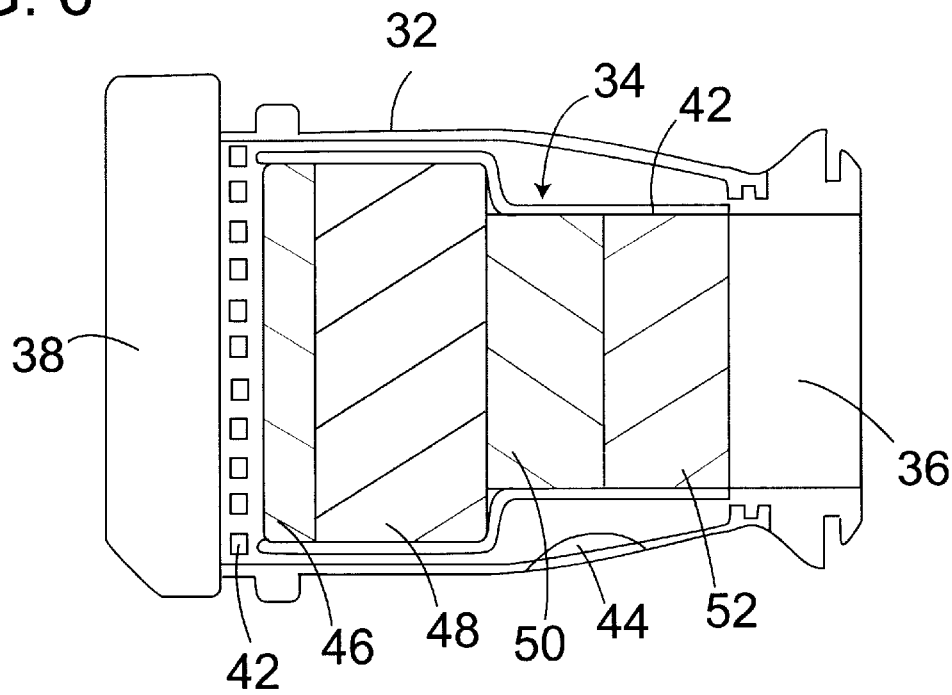
FIG. 6 is a sectional side view of the emergency filtration device.

FIG. 2 illustrates the replacement of regulator 16 by emergency filtration device, generally 30. As best illustrated in FIGS. 4–6, filtration device 30 includes an outer housing 32 enclosing a filter canister, generally 34. An adapter 36, including bayonet lugs in the illustrated embodiment, is mounted at the rear of housing 32 for use in attaching filtration device 30 to port 26. A cover or shield 38, which may be of a fire-retardant material and act as a flame cover to protect the filtration media, is mounted at the front of housing 32, and includes a thumb stop 40. Cover 38 is specifically designed to have a configuration corresponding to the configuration of front plate 22 of regulator 16. As illustrated, covers 22 and 38 are both circular and convex with a outwardly extending positioning projection. It will be understood, however, that cover 38 may be of different designs, so that cover 38 can be used with regulators having covers of different configurations, so long as the configuration of cover 38 corresponds, i.e, has a shape closely similar to, cover 22. A plurality of air intake ports 42 extend around housing 32 behind cover 38 to provide air access into the interior of housing 32. A one-way flutter valve 44 extends through the wall of housing 32 to allow escape of expired air.

Filter canister 34 is comprised of a canister housing 42 that encloses multiple filtration layers through which the contaminated air flows. These layers include a particulate filtration layer 46, a desiccant layer 48, an activated carbon layer 50 and a CO catalyst layer 52.

When the user discovers that the SCBA has malfunctioned or that tank 20 is empty, he or she quickly disconnects regulator 16 from mask 10, or the other part of the SCBA where regulator 16 is attached, detaches filtration device 30 from its storage location on the user's clothing or elsewhere, and attaches filtration device 30 in place of regulator 16. Generally, device 30 will be stored in a protective cover to prevent loss of filtration capability. Since cover 38 corresponds in shape to cover 22, the trained user, relying on "muscle memory" can quickly make the substitution, even in conditions of limited visibility.

While the invention has been described with references primarily to SCBA apparatus used by fire fighters, it will be understood that the invention is also useful with SCBA apparatus designed for other emergency and industrial uses. Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. An emergency air filtration device for use with a self-contained breathing apparatus including a regulator attachment port for attachment of a regulator having a cover of a given configuration, said filtration device comprising:

a) a filter housing having an outer end and an inner end adapted for connection to said attachment port;

b) air filtration media within said housing between said outer and inner ends; and c) a filtration device cover positioned in front of said outer end, said filtration device cover having a outer configuration corresponding to said given configuration.

2. The device of claim 1, wherein said filtration media is comprised of multiple layers of different filtration materials.

3. The device of claim 1, wherein said housing includes at least one one-way exhaust valve.

4. The device of claim 1, wherein said filtration device cover includes a position identifier.

5. The device of claim 1, wherein said inner end includes a bayonet connection.

6. The device of claim 1, wherein said filtration device cover is a flame retardant cover.

7. An emergency air filtration device for use with a self-contained breathing apparatus including a regulator attachment port for attachment of a regulator having a cover of a given configuration, said filtration device comprising:

a) a filter housing having an outer end and an inner end;

b) a connector positioned within said inner end for connecting said device to said attachment port;

c) air filtration media within said housing between said outer and inner ends; and d) a filtration device cover positioned in front of said outer end, said cover having a outer configuration corresponding to said given configuration.

8. The device of claim 7, wherein said filtration media is a multi-layer filtration media.

9. The device of claim 7, wherein said housing includes at least one one-way exhaust valve.

10. The device of claim 7, wherein said cover includes a position identifier.

11. The device of claim 7, wherein said inner end includes a bayonet connection.

12. The device of claim 7, wherein said self-contained breathing apparatus includes a face mask, said attachment port being in said face mask.

13. The device of claim 7, wherein said filtration device includes a plurality of air entry ports behind said filtration device cover.

14. An air filtration system comprising:

a) an air supply;

b) a face mask;

c) a hose extending from said air supply to said face mask;

d) a regulator controlling the supply of air from said air supply to said face mask, said regulator having a regulator cover with a given outer configuration; and e) an emergency air filtration device adapted to replace said regulator if said filtration system malfunctions said air supply is exhausted, said device including a filter housing, and air filtration media within said housing, and a filtration device cover, said filtration device cover having a outer configuration corresponding to the given configuration of said regulator cover.

15. The system of claim 14, wherein said filtration media includes a particulate filtration layer, an activated carbon layer and a carbon monoxide catalyst layer.

16. The system of claim 14, wherein said housing includes at least one one-way exhaust valve.

17. The system of claim 14, wherein said regulator cover and said filtration device cover include corresponding position indicators.

18. The system of claim 14, wherein said inner end includes a bayonet connection.

19. The system of claim 14, wherein said mask includes an attachment port, said regulator and said filter device being adapted for attachment to said attachment port.

20. The system of claim 14, wherein said regulator cover and said filtration device cover are both circular, convex, and include corresponding positioning projections.

* * * * *